United States Patent [19]

Adl et al.

[11] 4,447,337

[45] May 8, 1984

[54] STABIIZED GALACTOMANNAN GUM COMPOSITIONS

[75] Inventors: Mohammad S. Adl, West Covina; Gary H. Kegeler, Alta Loma; Howard L. Vandersall, Upland, all of Calif.

[73] Assignee: Monsanto Company, St. Louis, Mo.

[21] Appl. No.: 351,710

[22] Filed: Feb. 24, 1982

[51] Int. Cl.[3] ..... A62D 1/00

[52] U.S. Cl. ..... 252/7; 106/18.17; 252/8.05; 536/114; 536/121

[58] Field of Search ..... 106/18.19, 18.22, 18.17; 252/7, 8.05, 8.5 A; 536/114, 121

[56] References Cited

U.S. PATENT DOCUMENTS

| | | | |
|---|---|---|---|
| 4,060,132 | 11/1977 | Chiesa, Jr. | 252/8.05 |
| 4,060,489 | 11/1977 | Chiesa, Jr. | 252/8.05 |
| 4,112,223 | 9/1978 | Lin et al. | 536/114 |
| 4,225,592 | 9/1980 | Lakatos et al. | 536/121 |

FOREIGN PATENT DOCUMENTS

| | | | |
|---|---|---|---|
| 2724162 | 8/1977 | Fed. Rep. of Germany | 252/603 |
| 2921306 | 11/1979 | Fed. Rep. of Germany | 252/603 |

*Primary Examiner*—Leland A. Sebastian
*Attorney, Agent, or Firm*—J. H. Beusen; J. C. Logomasini; A. H. Cole

[57] ABSTRACT

Aqueous compositions thickened by galactomannan gums are described which are stabilized by a stabilizer system comprising soluble molybdenum and a thiourea.

28 Claims, No Drawings

STABIIZED GALACTOMANNAN GUM COMPOSITIONS

This application relates to galactomannan gum-thickened compositions and, particularly, to stabilization of such compositions against viscosity loss during storage, and more particularly, to the stabilization of galactomannan gum-thickened ammonium salt fire retardant compositions.

BACKGROUND OF THE INVENTION

Galactomannan gum thickeners are used where viscosity control of aqueous solutions or slurries is needed. For example, galactomannan gum thickeners are used to control the rheological properties of oil well drilling fluids and fire retardant compositions. When galactomannan gum-thickened aqueous compositions are stored for long intervals of time, viscosity loss sometimes occurs. The stability problem is more severe with compositions contacting steel apparently due to the destabilizing effect of ferrous ion. To extend storage stability of galactomannan gum-thickened compositions, the use of certain salts and of heavy metal ions have been proposed. See, for instance, U.S. Pat. Nos. 3,146,200 and 3,634,234. However, because of low efficacy of these known stabilizers, their use has not been generally accepted. Therefore, improved stabilizers for galactomannan gum-thickened compositions are needed.

SUMMARY OF THE INVENTION

It has now been discovered that improved galactomannan gum-thickened aqueous compositions are obtained by incorporation of a stabilizing amount of a stabilizer system comprising molybdenum and a thiourea. Viscosity stabilized compositions are obtained by incorporation into a galactomannan gum-thickened aqueous composition a stabilizer system comprising a water-soluble molybdenum compound and a thiourea of the formula

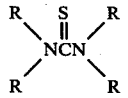

in which each R independently is hydrogen, alkyl of 1–3 carbon atoms, or one R of each nitrogen atom is joined to form an alkylene radical of 2–4 carbon atoms. Any amount of stabilizer system sufficient to reduce viscosity loss of the composition during storage is suitable for the practice of this invention. Generally, a viscosity stabilizing amount comprises from 0.00001 to 1 part by weight of molybdenum and 0.01 to 1 part by weight of thiourea per 100 parts by weight of water. Expressed in parts per million (ppm), the amount of molybdenum is generally about 0.1–10,000 ppm, and preferably, the amount of molybdenum is about 1–500 ppm, and more preferably is about 1–100 ppm. A sufficient quantity of soluble molybdenum compound is provided to give the indicated amounts of molybdenum containing ion.

One embodiment of the invention comprises aqueous fire retardant compositions comprising ammonium phosphate fire retardant, a viscosity increasing amount of galactomannan gum thickener and sufficient stabilizer system comprising water soluble molybdenum compound and thiourea, to reduce viscosity loss during storage of the composition. A typical composition comprises 1–20 parts by weight of ammonium phosphate fire retardant, 0.01 to 10 parts by weight of galactomannan gum thickener, 0.00001 to 1 part by weight of soluble molybdenum, and 0.01 to 1 part by weight of a thiourea, and 100 parts by weight of water.

All of the components of a fire retardant composition except water may be blended to form a concentrate, preferably, in powder form. The concentrate is then mixed with water and stored until needed. A typical concentrate comprises ammonium phosphate fire retardant, galactomannan gum thickener, and a viscosity stabilizing amount of a stabilizer system comprising a water soluble molybdenum compound and a thiourea. Generally, a concentrated composition of the invention comprises about 75 to 98 percent by weight of ammonium phosphate fire retardant, about 1 to 25 percent by weight of galactomman gum thickener, about 0.0001 to 1 percent by weight of a water soluble molybdenum compound and about 0.01 to 1 percent by weight of a thiourea. Preferred concentrated compositions comprise about 80 to 98 percent by weight of ammonium phosphate fire retardant and about 2 to 20 percent by weight of guar gum or ether derivatives of guar gum. Thus, the stabilizer system can either be added as an integral part of a dry powder concentrate or can be added directly to the fire retardant solution, either during or after dissolution. Other components, typically in ammonium phosphate fire retardant compositions, may also be present, such as, corrosion inhibitors, bactericides, defoamers, colorants and flow conditioners or other fire retardants such as ammonium sulfate.

One advantage of the stabilizer system of the invention is that it is effective in the presence of materials which accelerate viscosity loss of glactomannan gum-thickened aqueous compositions. For example, iron and other transition metals exert a deleterious effect upon the storage stability of galactomannan gum-thickened aqueous compositions. Regardless of the reason for the aforesaid deleterious effect, the stabilizer system of the invention inhibits the destabilization effect of these metals.

The stabilizer system of the invention is particularly effective in compositions having a pH of 8.0 or below. Preferred compositions are acidic, having a pH of about 4.0 to 7.0. Typical ammonium phosphate fire retardant compositions are acidic compositions having pH values within the preferred range.

The term galactomannan gum thickener as used herein refers to galactomannan gum and ether derivatives thereof which, when added to water, increases the viscosity of the resulting aqueous composition. Galactomannan gums are materials derived from a variety of leguminous plants such as locust beans and guar gum seeds. Galactomannan is a high molecular weight polysaccharide made up of many mannose and galactose units. The galactomannan gum molecule is essentially a straight chain mannan branched at regular intervals with galactose or mannose units. Derivatives of galactomannan gums are also valuable thickeners. Galactomannan gums may be substituted by addition of hydroxy alkyl or carboxy alkyl groups to the hydroxyl radical which resulting ether derivatives impart improved properties to the galactomannan gum. U.S. Pat. No. 4,272,414. The degree of etherification may vary from 0.01 to 0.9 moles. Normally, the degree of substitution is from 0.05 to 0.5 A preferred galactomannan gum thickener is guar gum or its ether derivatives. Typically, a viscosity increasing amount of galactomannan gum is about 0.01 to 10 parts by weight per 100 parts by weight of water. Preferably, about 0.1 to 5 parts by weight of galactomannan gum are used per 100 parts by weight of water.

Any ammonium phosphate fire retardant is suitable for the stabilized galactomannan gum-thickened compositions of the invention. Examples of satisfactory fire retardants are an ammonium phosphate selected from the group consisting of monoammonium orthophosphate; diammonium orthophosphate; monoammonium pyrophosphate; diammonium pyrophosphate; triammonium pyrophosphate; tetraammonium pyrophosphate; ammonium polyphosphates; ammonium-alkali metal mixed salts of ortho-, pyro-, and polyphosphates; ammonium-alkaline earth metal mixed salts of ortho-, pyro-, and polyphosphates; and mixtures thereof.

Any form of water-soluble molybdenum is suitable as a stabilizer for the practice of this invention. A preferred form of soluble molybdenum is a molybdate, for example, ammonium molybdate and alkali metal molybdate. Examples of satisfactory soluble molybdenum compounds are sodium molybdate, potassium molybdate, lithium molybdate, ammonium molybdate, molybdic acid, molybdic silicic acid, potassium molybdenum cyanate, molybdenum hydroxide, molybdenum oxychloride acid, molybdenum oxydichloride, molybdenum trisulfide, and complex forms of molybdate ion such as sodium-, ammonium-, and potassium-dimolybdates, trimolybdates, tetramolybdates, paramolybdates, tetramolybdates, octamolybdates, decamolybdates, and permolybdates.

Examples of suitable radicals for R of the thiourea stabilizer component are methyl, ethyl, propyl, and isopropyl.

Examples of satisfactory substituted thioureas are N,N-dimethylthiourea, N,N'-dimethylthiourea, trimethylthiourea, N,N'-diethylthiourea, N,N'-diisopropylthiourea, N-ethyl-N'-methylthiourea, N-ethyl-N-methylthiourea, and tetramethylthiourea. Unsubstituted thiourea is a preferred stabilizer. Examples of cyclic thioureas are ethylene thiourea (2-mercaptoimidazoline), trimethylene thiourea, tetramethylene thiourea.

DESCRIPTION OF THE PREFERRED EMBODIMENTS

Fire retardant composition is prepared by blending, to form a solid concentrate in powder form, monoammonium phosphate, hydroxypropyl ether of guar gum, flow conditioner, colorant, and defoamer agent as shown in Table 1. An aqueous fire retardant composition is then formed by mixing the dry concentrate with water. A stabilizer system comprising sodium molybdate and thiourea, $$H_2N\overset{\overset{\displaystyle S}{\|}}{C}NH_2,$$

is then added at the indicated concentrations to portions of the above-described fire retardant composition. Steel coupons are inserted into the compositions to illustrate the efficacy of the stabilizer system in the presence of iron contamination. The steel coupon is submerged to a depth to provide 52 sq. cm. of surface area per liter of retardant solution.

TABLE 1

| FIRE RETARDANT COMPOSITION (Parts by Weight) | |
|---|---|
| Water | 100 |
| Monoammonium Orthophosphate | 10.56 |
| Guar Gum | 1.02 |
| Flow Conditioner | 0.24 |
| Colorant | 0.12 |
| Bacteriocide | 0.048 |
| Defoamer | 0.006 |
| Stabilizer System | Varied |

The compositions are stored at 23° C. Compositions containing no stabilizer or a single component of the stabilizer system are controls. The viscosity of the compositions is monitored at various time intervals by using a Model LVF Brookfield viscometer, spindle No. 4 at 60 rpm. The stabilizing effect of the stabilizer system upon the viscosity of the compositions is shown in Table 2.

The data show that the control composition containing no stabilizer undergoes a substantial loss in viscosity retaining less than 5 percent of the viscosity of the original sample. The composition containing only thiourea and only molybdenum retain 13% and 38% respectively, of the original viscosity, whereas, compositions containing both thiourea and molybdenum retain 72% to 79% of the original viscosity depending upon the amount of thiourea present.

Fire retardant compositions are prepared containing the same components as in Table 1 except 0.036 parts per weight of bactericide are used. Duplicate compositions are stored at 23° C. and at 49° C. The viscosities are measured of samples without steel coupons and with steel coupons inserted therein to give 16 sq. cm. of surface per liter of solution. The data is tabulated in Table 3. Samples 1 and 4 are controls containing no stabilizer. Samples 2 and 5 contain only molybdenum. Samples 3 and 6 illustrating stabilizer systems of the invention contain both thiourea and molybdenum.

TABLE 2

| | (Parts by Weight) | | Viscosity, Centipoise | | |
|---|---|---|---|---|---|
| Sample No. | $Na_2MoO_4.2H_2O$ | Thiourea | Initial (10 min.) | After Aging (days) | % Retention |
| 1 | 0 | 0 | 1910 | 100[1] | 5% |
| 2 | 0 | 0.12 | 1910 | 250[1] | 13% |
| 3 | 0.012* | 0 | 1910 | 730[1] | 38% |
| 4 | 0.012* | 0.06 | 2133 | 1530[2] | 72% |
| 5 | 0.012* | 0.12 | 2133 | 1637[2] | 77% |
| 6 | 0.012* | 0.24 | 2133 | 1660[2] | 79% |

*(41 ppm Mo)
[1] = 35 days
[2] = 30 days

TABLE 3

| | (Parts by Weight) | | | Viscosity, Centipoise | | | | | |
|---|---|---|---|---|---|---|---|---|---|
| | | | | 23° C. | | | 49° C. | | |
| Sample No. | $Na_2MoO_4.2H_2O$ | Thiourea | Steel | Initial | 48 Days Aging | % Retention | Initial | 17 Days Aging | % Retention |
| 1 | 0 | 0 | No | 1483 | 283 | 19 | 1489 | 100 | 7 |
| 2 | 0.024 (82 ppm Mo) | 0 | No | 1508 | 1193 | 79 | 1539 | 506 | 33 |
| 3 | 0.024 (82 ppm Mo) | 0.12 | No | 1538 | 1327 | 86 | 1496 | 929 | 62 |
| 4 | 0 | 0 | Yes | 1508 | 90 | 6 | 1535 | <100 | |
| 5 | 0.024 (82 ppm Mo) | 0 | Yes | 1516 | 623 | 41 | 1503 | 237 | 16 |
| 6 | 0.024 (82 ppm Mo) | 0.12 | Yes | 1493 | 1117 | 75 | 1522 | 872 | 57 |

The data show that viscosity loss is greater with iron contamination and at elevated storage temperature, but that the compositions containing a stabilizer system comprising thiourea and molybdenum retain a greater percentage of their original viscosities.

The viscosity stabilization of aqueous ammonium phosphate fire retardant composition with different water-soluble molybdenum compounds is illustrated in Table 4. The fire retardant composition is similar as in Table 1. The amount of thiourea is 0.12 parts by weight in each composition. The amount of molybdenum compound is varied to give a molybdenum concentration of 45 ppm based upon the total weight of the composition. In duplicate compositions, steel coupons are inserted to provide 52 sq. cm. of exposed surface per liter of solution to illustrate the efficacy of the stabilizer system in the presence of iron contamination. The compositions are stored at 23° C. The viscosity is monitored as before. The results are shown in Table 4. The data show that the control without stabilizer retains 92% of its original viscosity after 23 days but, when contaminated with iron, the control retains only 22% of its original viscosity. The data show that the samples containing the stabilizer system of the invention essentially maintain their original viscosities and, when contaminated with iron, they retain about 80% of their original viscosities.

TABLE 4

| | | % Viscosity Retention | |
|---|---|---|---|
| Stabilizer (45 ppm Mo) | Steel Coupon | After 23 Days | After 38 Days |
| None | No | 92 | 88 |
| | Yes | 22 | 12 |
| $Na_2MoO_4.2H_2O$ | No | 99 | 99 |

TABLE 4-continued

| | | % Viscosity Retention | |
|---|---|---|---|
| Stabilizer (45 ppm Mo) | Steel Coupon | After 23 Days | After 38 Days |
| | Yes | 81 | 71 |
| $(NH_4)6Mo_7O_{24}.4H_2O$ | No | 100 | 103 |
| | Yes | 83 | 75 |
| $H_2MoO_4.H_2O$ | No | 97 | 101 |
| | Yes | 79 | 73 |

TABLE 5

| | | | Viscosity, Centipoise | | | | |
|---|---|---|---|---|---|---|---|
| | | | 23° C. | | | 49° C. | |
| Sample No. | Thiourea | Steel (Sq. cm.) | Initial | 34 Days Aging | % Retention | 34 Days Aging | % Retention |
| 1 | None | 16 | 1567 | 847 | 54 | <100 | <6 |
| | None | 52 | 1567 | 653 | 42 | — | — |
| 2 | Thiourea | 16 | 1560 | 1250 | 80 | 870 | 56 |
| | Thiourea | 52 | 1560 | 1163 | 75 | — | — |
| 3 | N,N'—Diethyl-thiourea | 16 | 1567 | 1183 | 75 | 738 | 47 |
| | N,N'—Diethyl-thiourea | 52 | 1567 | 1053 | 67 | — | — |
| 4 | Ethylene-thiourea | 16 | 1520 | 1210 | 80 | 742 | 49 |
| | Ethylene-thiourea | 52 | 1520 | 1003 | 66 | — | — |
| 5 | Tetramethyl-thiourea | 16 | 1670 | 1177 | 70 | 592 | 35 |
| | Tetramethyl-thiourea | 52 | 1670 | 997 | 60 | — | — |

The efficacy of stabilizer systems containing different thioureas are illustrated in Table 5. The fire retardant compositions are the same as in Table 1. Sample 1 contains 41 ppm of molybdenum alone. All other compositions contain 41 ppm of molybdenum and 0.12 parts by weight of a thiourea. To illustrate the effect of storage temperature and the effect of iron contamination concentration, triplicate compositions are prepared and steel coupons are inserted to give the indicated surface exposure. Duplicate compositions are stored at room temperature and 49° C. Viscosity is monitored periodically as before. The data show the efficacy of substituted thioureas.

Although the invention has been illustrated by typical examples, it is not limited thereto. Changes and modifications of the examples of the invention herein chosen for purposes of disclosure can be made which do not constitute departure from the spirit and scope of the invention.

The embodiments of the invention in which an exclusive property or privilege is claimed are defined as follows:

1. An aqueous fire retardant composition comprising ammonium phosphate fire retardant selected from the group consisting of monoammonium orthophosphate; diammonium orthophosphate; monoammonium pyrophosphate; diammonium pyrophosphate; triammonium pyrophosphate; tetraammonium pyrophosphate; ammonium polyphosphates; ammonium-alkali metal mixed salts of ortho-, pyro-, and polyphosphates; ammonium-alkaline earth, metal mixed salts of ortho-, pyro-, and polyphosphates; and mixtures thereof, a viscosity increasing amount of a galactomannan gum thickener, and, in an amount effective to reduce viscosity loss of the composition during storage, a stabilizer system comprising a mixture of water-soluble molybdenum compound and a thiourea of the formula

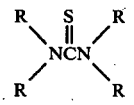

in which each R independently is hydrogen, alkyl of 1–3 carbon atoms, or one R of each nitrogen atom are joined to form an alkylene radical of 2–4 carbon atoms.

2. The composition of claim 1 comprising 1–20 parts by weight of ammonium phosphate fire retardant, 0.01 to 10 parts by weight of galactomannan gum thickener, stabilizer system comprising about 0.00001 to 1 part by weight of a soluble molybdenum compound and 0.01 to 1 part by weight of a thiourea, and 100 parts by weight of water.

3. The composition of claim 1 in which the galactomannan gum thickener is an ether derivative of guar gum.

4. The composition of claim 3 in which the soluble molybdenum compound is ammonium or alkali metal molybdate.

5. The composition of claim 4 comprising about 1 to 100 ppm of molybdenum.

6. The composition of claim 5 in which the fire retardant is monoammonium orthophosphate, diammonium orthophosphate, or mixtures thereof.

7. The composition of claim 6 comprising 0.05 by 0.5 parts by weight of a thiourea.

8. The composition of claim 7 in which each R is hydrogen.

9. The composition of claim 7 in which one R on each nitrogen is joined to form an alkylene radical of 2–4 carbon atoms and the remaining R's are hydrogen.

10. The composition of claim 7 in which one R on each nitrogen is hydrogen and the other R on each nitrogen is alkyl.

11. The composition of claim 7 in which each R is lower alkyl.

12. The composition of claim 11 in which R is methyl.

13. The composition of claim 10 in which R is methyl.

14. The composition of claim 10 in which R is ethyl.

15. The composition of claim 8 in which the soluble molybdenum compound is sodium molybdate.

16. The composition of claim 6 having a pH of 8 or below.

17. The composition of claim 16 having a pH of about 4.0 to 7.0.

18. The composition of claim 7 in contact with iron or ferrous metal containing alloy.

19. A concentrated composition suitable for the preparation of storable aqueous fire retardant compositions comprising an ammonium phosphate fire retardant selected from the group consisting of monoammonium orthophosphate; diammonium orthophosphate; monoammonium pyrophosphate; diammonium pyrophosphate; triammonium pyrophosphate; tetraammonium pyrophosphate; ammonium sulfate; ammonium polyphosphates; ammonium-alkali metal mixed salts of ortho-, pyro-, and polyphopshates; ammonium-alkaline earth metal mixed salts of ortho-, pyro-, and polyphosphates; and mixtures thereof, a galactomannan gum thickener, and, in an amount effective to reduce viscosity loss during storage of a galactomannan gum-thickened aqueous fire retardant composition, a stabilizer system comprising a mixture of a water-soluble molybdenum compound and a thiourea of the formula

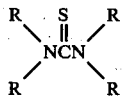

in which each R independently is hydrogen, alkyl of 1–3 carbon atoms, or one R of each nitrogen atom are joined to form an alkylene radical of 2–4 carbon atoms.

20. The concentrated composition of claim 19 comprising about 50 to 98 percent by weight of ammonium phosphate fire retardant, about 2 to 25 percent by weight of galactomannan gum thickener, stabilizer system comprising about 0.0001 to 1 percent by weight of a water soluble molybdenum compound and 0.01 to 1 percent by weight of a thiourea.

21. The concentrated composition of claim 20 comprising about 80 to 98 percent by weight of ammonium phosphate fire retardant selected from the group consisting of monoammonium orthophosphate, diammonium orthophosphate, or mixtures thereof, and about 2 to 20 percent by weight of guar gum or ether derivative of guar gum.

22. A method for preserving the rheological properties of a galactomannan gum-thickened aqueous ammonium phosphate fire retardant composition containing an ammonium phosphate fire retardant selected from the group consisting of monoammonium orthophosphate, diammonium orthophosphate; monoammonium pyrophosphate; diammonium pyrophosphate; triammonium pyrophosphate; tetraammonium pyrophosphate; ammonium, polyphosphates; ammonium-alkali metal mixed salts of ortho-, pyro-, and polyphosphates; ammonium-alkaline earth metal mixed salts of ortho-, pyro-, and polyphosphates; and mixtures thereof which comprises incorporating therein, in an amount effective to reduce viscosity loss of the composition during storage, a stabilizer system comprising a water-soluble molybdenum compound and a thiourea of the formula

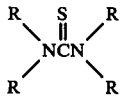

in which each R independently is hydrogen, alkyl of 1–3 carbon atoms, or one R of each nitrogen atom are joined to form an alkylene radical of 2–4 carbon atoms.

23. The method of claim 22 which comprises incorporating into a composition comprising about 1–20 parts by weight of ammonium phosphate fire retardant, 0.01 to 10 parts by weight of galactomannan gum thickener, and 100 parts by weight of water, a stabilizer system comprising about 0.00001 to 1 part by weight of water-soluble molybdenum compound and 0.01 to 1 part by weight of a thiourea.

24. The method of claim 23 wherein the ammonium phosphate fire retardant is ammonium orthophosphate, diammonium orthophosphate, or mixtures thereof.

25. The method of claim 24 wherein the galactomannan gum thickener is an ether derivative of guar gum.

26. The method of claim 25 wherein the molybdenum compound is ammonium or alkali metal molybdate present in the amount of 1 to 100 ppm of molybdenum.

27. The method of claim 26 wherein each R is hydrogen.

28. The method of claim 27 wherein the molybdenum compound is sodium molybdate.

* * * * *